US007779847B2

(12) United States Patent
Castagno et al.

(10) Patent No.: US 7,779,847 B2
(45) Date of Patent: Aug. 24, 2010

(54) APPARATUS AND METHODS FOR MANIPULATING HAIR PROCESSING MATERIALS

(76) Inventors: Robert David Castagno, 18 Old Dutch Rd., Warren, NJ (US) 07058; William James Coleman, 14 Oak La., Green Pond, NJ (US) 07435

( * ) Notice: Subject to any disclaimer, the term of this patent is extended or adjusted under 35 U.S.C. 154(b) by 0 days.

(21) Appl. No.: 11/414,285

(22) Filed: Apr. 28, 2006

(65) Prior Publication Data

US 2007/0169790 A1 Jul. 26, 2007
US 2008/0053475 A2 Mar. 6, 2008

Related U.S. Application Data

(63) Continuation-in-part of application No. 11/342,291, filed on Jan. 26, 2006, now abandoned.

(51) Int. Cl.
*A45D 7/00* (2006.01)

(52) U.S. Cl. ..... 132/200

(58) Field of Classification Search ..... 132/320, 132/148, 150, 124, 219, 152, 111–116, 207, 132/208, 200; 15/188, 245, 104.001; 401/286; D4/135

See application file for complete search history.

(56) References Cited

U.S. PATENT DOCUMENTS 2,099,030 A * 11/1937 Morrison ..... 427/274
D118,810 S * 2/1940 Berry ..... D28/29
2,591,301 A * 4/1952 Schacht ..... 15/245
2,699,565 A * 1/1955 Brough ..... 15/245
3,065,485 A * 11/1962 Solaini ..... 15/245
5,042,512 A 8/1991 Knight
5,433,225 A * 7/1995 Liggett et al. ..... 132/208
5,491,869 A * 2/1996 Sullivan et al. ..... 15/245
5,655,551 A 8/1997 Knight
6,684,887 B2 * 2/2004 Alexander ..... 132/112
7,182,377 B2 * 2/2007 Grundler ..... 294/7
7,185,385 B2 * 3/2007 Kohler ..... 15/104.001

* cited by examiner

*Primary Examiner*—Robyn Doan
(74) *Attorney, Agent, or Firm*—Gearhart Law, LLC.

(57) ABSTRACT

Disclosed are apparatus and methods for efficiently and effectively manipulating spreadable materials. Such apparatus and methods may be incorporated for uses such as applying spreadable materials such as hair color, relaxers, and the like to a surface such as the surface of strands of hair for the purpose of highlighting or otherwise processing hair. A variety of applicators including varying edges, surfaces, tapers, and dimensions are disclosed, wherein each applicator configuration creates a different effect when used for hair processing. Furthermore, a hair stylist may select one or more of the disclosed applicators based upon ease of use for the particular hair stylist, personal preference, and/or the type of hair to be processed. The applicators disclosed herein retain their rigidity during use, are fast-drying, create less waste, and are easy to clean. In one embodiment, a user may tailor the applicator's head design to meet his or her personal needs.

1 Claim, 13 Drawing Sheets

I
116
100
108
110
106
102
104
118
I 116
100
108
110
106
104
118
102
d 116
100
108
110
106
104
114
112
102

III
316
300
308
310
306
320
302
304
III 316
300
308
310
306
320
302
304

316
300
308
310
306
312
314
304
$h_2$
302

V
516
500
508
510
506
502
504
518
V 216
500
508
510
506
518
502
504

516
500
508
510
506
514
512
$h_4$
502
504

VIII
816
800
808
810
806
818
804
IX
802
IX
VIII 816
800
808
810
806
804
802
818

816
800
808
810
806
812
814
802
804

APPARATUS AND METHODS FOR MANIPULATING HAIR PROCESSING MATERIALS

CROSS-REFERENCE TO RELATED APPLICATIONS

This application claims the benefit of and is a continuation-in-part of the U.S. non-provisional patent application entitled "Apparatus and Methods for Manipulating Spreadable Materials", having Ser. No. 11/342,291, filed Jan. 26, 2006, now abandoned, which is incorporated by reference in its entirety as if fully set forth herein.

BACKGROUND OF THE INVENTION

Embodiments of the present invention generally relate to apparatus and methods for efficiently and effectively manipulating spreadable materials. More specifically, the present invention relates to apparatus and methods for applying spreadable materials such as hair color to a surface such as the surface of strands of hair.

Many systems and methods have been created to apply hair creams and lotions to the hair. Many such systems and methods have been created in the form of an applicator. In its most simplistic form, such systems include a rat-tail handled applicator having a head shaped as a blade. In one such system, the stylist applies hair products such as relaxing creams, setting creams, and lotions via the blade and may use such blade to scrape off any excess hair product. The rat-tail handle allows the stylist to reverse the applicator to use such handle to separate the hair without changing tools.

Similarly, another applicator is disclosed having a head shaped as a comb and a rat-tail handle. However, one side of the comb end is serrated to allow the applicator to better hold the hair. To use the applicator, the flat side of the comb is aligned against the hair such that the flat blade is perpendicular to the hair. Lotion is then applied above the applicator such that the flat portion of the applicator catches any spilled lotion. The applicator is then rotated such that it is parallel to the hair thereby allowing the excess lotion on the comb to come in contact with the hair.

In addition, highlighting brushes exist. Such brushes are immersed in a colorant such as a bleaching agent and are then used to paint the colorant on the desired strands of hair. In some scenarios, the hair to which such colorant has been applied is then wrapped in a material such as foil to prevent the colorant from accidentally contacting adjacent hair.

In a similar but more complex system, a set of tools that includes a palette, a color board, and a color blade is disclosed. In this system, a layer of hair coloring agent is placed on the color palette. A piece of foil such as aluminum foil is then wrapped around the color board such that one side is entirely covered with foil and the other side is partially covered with foil. The color board is placed perpendicular to the scalp directly below the strands of hair to be colored with the completely foiled side facing upward. One side of the color blade is then used to remove the coloring agent from the color palette and to apply it to the hair. The opposing side of the color blade is kept clean to prevent accidental application of the coloring agent to the scalp or adjacent strands of hair. After application of the coloring agent, the foil is wrapped around the hair to allow the color to set. This process is then repeated until all desired portions of the hair have been treated with the coloring agent.

BRIEF SUMMARY OF THE INVENTION

In one aspect of the present invention, disclosed is an apparatus for manipulating a spreadable material including a head including a tip having equally tapered upwardly and downwardly facing surfaces and a handle coupled to said head, wherein said head is manufactured from a semi-rigid material, wherein said equally tapered upwardly and downwardly facing surfaces increases the flexibility of said tip, and wherein said spreadable material may be painted on a surface via said tip.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments that are presently preferred. It should be understood, however, that the invention is not limited to the precise arrangements and instrumentalities shown. In the drawings.

DETAILED DESCRIPTION OF THE INVENTION

Figures 1A, 1B, 1C:
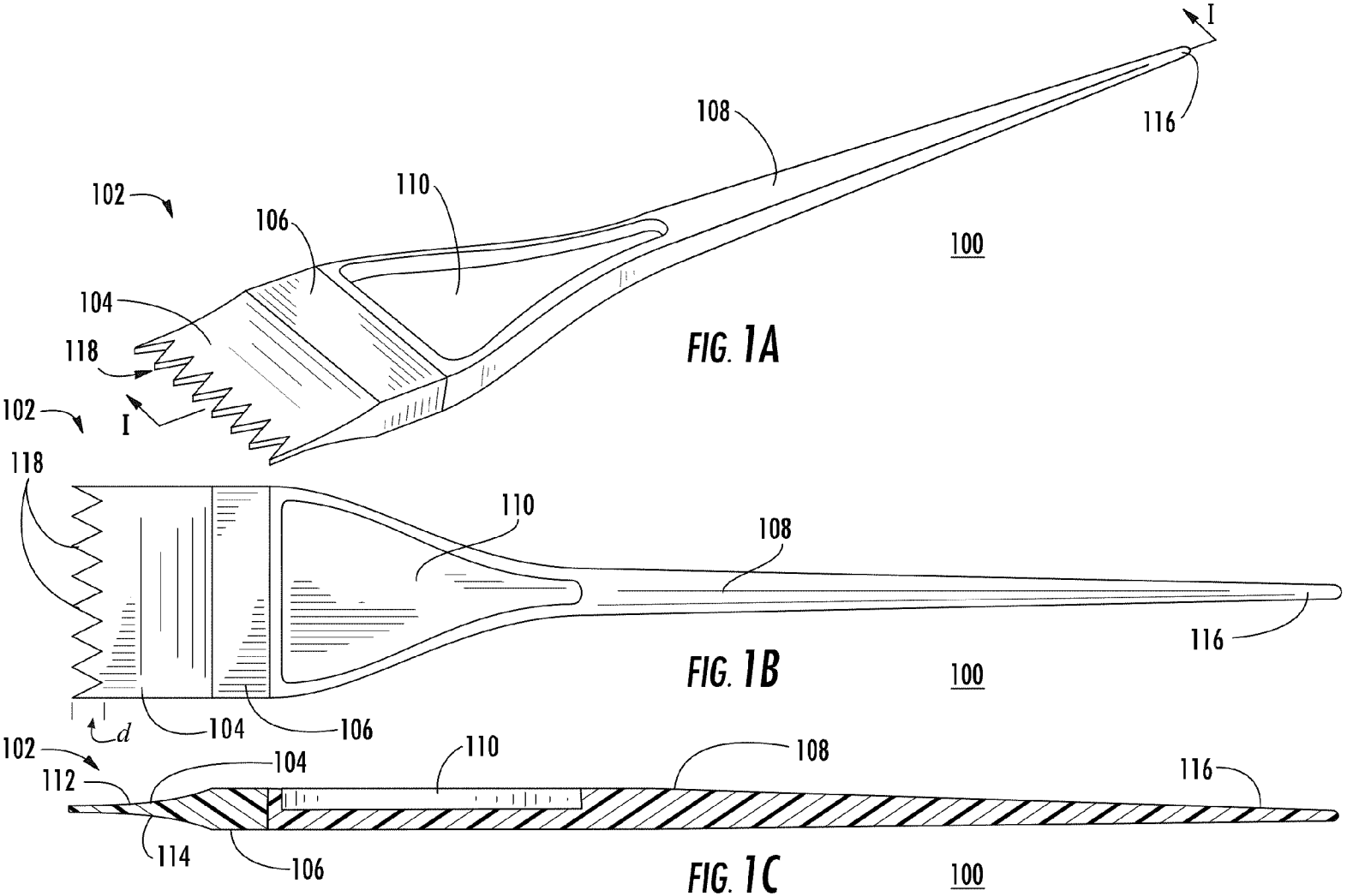
FIG. 1A is a perspective view of an apparatus for manipulating spreadable material having serrated teeth in accordance with one embodiment of the present invention.
FIG. 1B is a top view of the apparatus depicted in FIG. 1A.
FIG. 1C is a cross-sectional view of the apparatus depicted in FIG. 1A taken along lines I-I of FIG. 1A.

Referring first to FIGS. 1A-1C, depicted is a perspective view of an apparatus for manipulating spreadable material having a serrated tip in accordance with one embodiment of the present invention. In the depicted embodiment of the present invention, applicator 100 includes head 102, handle 108, and indentation 110.

In some embodiments of the present invention, head 102 includes a first head end 104 and a second head end 106. First head end 104 is the portion of applicator 100 used to apply spreadable material such as hair color, lightener, bleach, tint, or the like to a surface such as the surface of a selected set of hair strands. First head end 104 includes a proximal edge having the same width and height as second head end 106. Although the width remains constant throughout the depth of first head end 104, the upwardly and downwardly facing surfaces 112 and 114, respectively, of first end 104 taper inward equally as depicted in the side view of applicator 100 (as depicted in FIG. 1C) such that a flexible edge having a relatively small height is formed at the distal end of head 102. Such tapering allows first head end 104 to flex, thereby allowing applicator 100 to be used as a paintbrush. That is, a spreadable material may be applied to both the upwardly and downwardly facing surfaces 112 and 114, respectively, of first head end 104 and such material may be applied to a surface via bi-directional brushing or painting motions. Such application allows a greater quantity of the spreadable material to be applied to head 102 in each instance, thereby decreasing the time required to perform a process such as highlighting hair. Furthermore, the ability to apply the spreadable material to both surfaces of head 102 minimizes and/or eliminates the precision required when applying such material to head 102. That is, a hair colorist does not have to be careful to avoid accidental application of the spreadable material to one of the two surfaces of head 102. This feature of the present invention facilitates use of any process incorporating applicator 100. However, such spreadable material may be applied to a single surface of head 102 without departing from the scope hereof.

In many embodiments of the present invention, bi-directional brushing or painting motions will result in better and/or faster application of the spreadable material to the intended surface. Bi-directional brushing allows the spreadable material on each surface of head 102 to be applied to the same intended surface as compared to a uni-directional application of material in which spreadable material on a single surface of head 102 only may be applied to the intended surface.

In contrast to use of a brush, applicator 100 is quick and easy to clean. Also, the rigidity of applicator 100 is constant in both a wet and dry state as compared to a brush, which becomes softer and less rigid when wet. As compared to a brush, spreadable materials may be washed from applicator 100 easily via rinsing or wiping. That is, there are no individual bristles that must be individually separated and cleaned. In addition, applicator 100 may be re-used consecutively without waiting for it to dry and without any loss of rigidity. Since applicator 100 has head 102 formed of a solid piece, applicator 100 may be manually dried with a cloth, towel, or the like, as compared to a brush for which a user must wait for the individual bristles to completely dry in order for its rigidity to return. Therefore, a busy hair colorist may use a single applicator 100 to service a plurality of consecutive clients, whereas the same hair colorist would require multiple brush-type applicators to service the same quantity of clients. Furthermore, the applicators of the present invention will last longer than a typical bristle brush due to the nature of the head material, while also eliminating the need to trim and/or replace bristles. However, in some aspects of the present invention, the head material is as stiff as a typical bristle brush, thereby providing the same feel to the user.

First head end 104 is coupled to handle 108 via second head end 106. Second head end 106 is provided to add strength to head 102 and to prevent uncontrollable or hard-to-control flexing of first head end 104. That is, second head end 106 provides greater control to a user of applicator 100 by minimizing the natural flex of first head end 104 (i.e., flex that is not created by a user of applicator 100). However, alternate embodiments of the present invention are envisioned in which second head end 106 is omitted (i.e., first head end 104 is coupled directly to handle 106) without departing from the scope of the present invention. Or, alternatively, second head end 106 may be formed in a different configuration than that depicted in FIGS. 1A-1C without departing from the scope hereof.

In some embodiments of the present invention, handle 108 includes a proximal end having an equal width and height to second head end 106. However, handle 108 gradually tapers as it approaches its distal end, which is long and narrow and includes handle point 116 at the far distal end. The proximal end of handle 106 is of sufficient width that a user of applicator 100 may hold it with multiple fingers, thereby providing a better grip closer to head 102, which typically provides the user with better and more accurate control of head 102. Handling of applicator 100 may be alternated between the proximal and distal ends of handle 106 as needed and depending on the type of brushing and/or spreading motions desired.

In one aspect of the present invention, the handle 108 includes indentation 110. Indentation 110 is recessed below the surface of the proximal end of handle 106 to provide a user of applicator 100 with better control of applicator 100. For one, the perimeter of indentation 110 is raised to prevent and/or minimize the possibility that a user's fingers will slip off of applicator 100. In addition, the recessed nature of indentation 110 allows a user to place his or her forefinger, index finger, and the like closer to his or her thumb, providing a better grip of applicator 100 and potentially better control thereof. That is, the recessed nature of indentation 110 minimizes the space between a user's forefinger, index finger, and the like, which are typically placed atop the upwardly facing surface of indentation 110, and a user's thumb, which is typically placed on the downwardly facing surface of the proximal end of handle 108.

Furthermore, inclusion of indentation 110 or the like in applicator 100 reduces the weight of such apparatus. This lighter weight increases the ease with which applicator 100 may be used by producing less stress for the hair colorist's hands, potentially preventing stress and/or repetitive stress related ailments such as Carpal Tunnel Syndrome. The lighter weight is also likely to increase the length of time a hair colorist may work continuously prior to fatigue of the hands, wrists, and the like. However, handles without indentations 110 may be substituted without departing from the scope hereof.

Handle point 116 allows applicator 100 to be reversed when required such that handle point 116 may be used to manipulate and/or reposition strands of hair while removing a minimal amount, if any, of the spreadable material therefrom. However, alternate configurations for handle 108 may be substituted without departing from the scope of the present invention.

In some aspects of the present invention, head 102 is manufactured from a semi-rigid soft rubber material such as thermal plastic elastomer and the like. However, other materials (e.g., low density polyethylene) may be substituted without departing from the scope hereof. The semi-rigid nature of the material allows head 102 to flex as needed for application of a spreadable material. For ease of manufacturing, handle 108 may also be formed of the same material, however, handle 108 may be formed of alternative materials (e.g., rigid materials) such as polypropylene without departing from the scope of the present invention.

In one method of manufacturing the applicator of the present invention, a mold is created for the intended applicator head. This mold is designed such that it holds the handle in place prior to filling the mold. After the handle has been inserted into the mold, the mold is filled with a material such as those discussed in the preceding paragraph, such that the head is molded directly onto the handle. Also, in some aspects of the present invention, each head style is manufactured with a dedicated color for ease of identification. However, varying methods of manufacturing and identification methods may be substituted without departing from the scope of the present invention.

In another aspect of the present invention, each applicator is provided with a pair of identification devices such as molded pieces capable of being mounted upon an applicator and an accompanying device such as a hair coloring bowl, a bowl of hair relaxer material, a can of paint etc. One identification device is then mounted upon the applicator and the other identification device is mounted upon the accompanying device to allow the two to be continually associated after their initial use. Such identification devices are optional and are not required to achieve the goals of the present invention.

In one aspect of the present invention, applicator 100 is used to apply color during a hair highlighting process. In such a process, the hair colorist typically separates a set of strands of hair to be highlighted from adjacent hair, which will not be highlighted. In some embodiments, aluminum foil, plastic wrap, or the like is placed below the strands to be highlighted and the hair colorist holds the strands of hair held atop the aluminum foil, plastic wrap, or the like with a first hand while applying the color via applicator 100 with the second hand. The color may be contained in a bowl or the like, into which head 102 of applicator 100 is dipped to pickup the color to be applied. Thereafter, the color is brushed onto the hair.

The equally tapered nature of head 102 allows the hair colorist to apply color close to the scalp, without accidentally applying color to the scalp or to the roots of adjacent strands of hair, which are not to be colored. This close to the scalp application of the color provides a longer lasting highlight that minimizes the frequency of touchups for the person receiving the highlights (the "client") since the close to the scalp application of color will lengthen the time required for the client to see roots of his or her hair having its natural color. That is, applying color close to the scalp lengthens the time required for the hair to grow to a length at which the hair's natural color is seen. This lengthening of time saves the client money and time by minimizing his or her visits to the hair salon.

The ability of the hair colorist to apply color close to the scalp without accidentally applying color to the scalp or to the roots of adjacent strands of hair, which are not to be colored, is also of importance. Although such mistaken application of color may not be immediately noticeable, as the client's hair grows, mistaken application of color will show itself in the form of one or more large spots of color. Such spots of color are highly undesirable and may cost the hair colorist business. However, the tapered nature of head 102 allows the stylist to apply color close to the scalp without affecting the adjacent areas, since the color may be pinpointed on the hair by the narrow edge of head 102. In the tapered embodiment of the present invention depicted in FIG. 1A, color may be contained between serrated teeth 118, thereby resulting in a horizontal application of color (relative to the position of applicator 100) rather than a vertical application of color.

Additionally, applicator 100 may be used to apply relaxers or similar hair straightening products to hair. Because relaxers and other straightening products often include harsh chemicals, it is important that they do not physically contact the scalp. Such contact may cause burning or irritation to the skin, which may result in the loss of a client. Use of applicator 100 when applying such relaxer-type products reduces the potential for such contact with the skin while still allowing the relaxer to be applied close to the scalp.

Although applicator 100 may be used alone without the use of any items (e.g., foil, plastic wrap, coloring boards, etc.) other than the material such as a hair processing material, it may also be used in conjunction with such items without departing from the scope hereof. In one aspect of the present invention, applicator 100 is used for baliage (i.e., a process in which hair color or hair lightener is handpainted freestyle onto selected strands of hair). However, other uses of applicator 100 are envisioned without departing from the scope hereof.

Additionally, the use of applicators such as applicators 100-900 for application of a spreadable material to a surface reduces the waste of the material during application of same since such material cannot typically penetrate the applicator. That is, contrary to a brush-style applicator in which a portion of the applied material is typically unused because it is lost between the bristles of the brush, the applicators of the present invention allow all of the applied material to be applied to the surface with virtually no waste. This decreases the quantity of material required for a particular application, thereby reducing the cost associated with such material.

Similarly, the loss of waste between the brush bristles allows a greater quantity of product to be applied to the surface in each application of the material, thereby facilitating some uses of the applicator such as chemical straightening of the hair, which involves application of relaxers and the like to the hair. In such embodiments, the time required to complete the straightening process is reduced due to the ability of the user to apply a greater quantity of the material during each stroke, thereby minimizing the quantity of total strokes required.

Referring next to FIG. 1B, a top view of applicator 100 including a view of serrated teeth 118 is depicted. The serrated nature of head 102 breaks the straight line of an applicator such as applicator 200 (FIGS. 2A-2C), thereby providing a more natural look. In one aspect of the present invention, a weaved, soft, natural look is provided. In the depicted embodiment, the depth d of each serrated tooth 118 is approximately 3/32 inches and the angle of each of the two sides of each tooth is approximately 20 degrees. However, serrated teeth 118 having varying depths (e.g., 1/16 inch, 1/8 inch, etc.) and varying angles (e.g., 30 degrees, 45 degrees, etc.) may be substituted without departing from the scope of the present invention. Varying the depth and/or angle of serrated teeth 118 varies the look of the highlight achieved via use of applicator 100. Therefore, a hair colorist may be equipped with a plurality of applicators 100 having varying dimensions, as well as applicator 200 (FIGS. 2A-2C), applicator 300 (FIGS. 3A-3C), applicator 400 (FIGS. 4A-4C), applicator 500 (FIGS. 5A-5C), applicator 600 (FIGS. 6A-6D), applicator 700 (FIGS. 7A-7C), applicator 800 (FIGS. 8A-8D), and/or applicator 900 (FIGS. 9A-9C) such that the appropriate applicator may be selected to achieve the desired highlighting affect.

Turning now to FIG. 1C, depicted is a cross-sectional view of applicator 100 taken along lines I-I of FIG. 1A further detailing the equally tapered nature of first head end 104, as well as the tapered nature of handle 108. The equally tapered nature of first head end 104 contributes to its brush-like and flexible nature, however, varying tapers may be substituted without departing from the scope of the present invention. Furthermore, the tapered nature of handle 108 proves handle point 116 as present in some embodiments of the present invention.

Figures 2A, 2B, 2C:
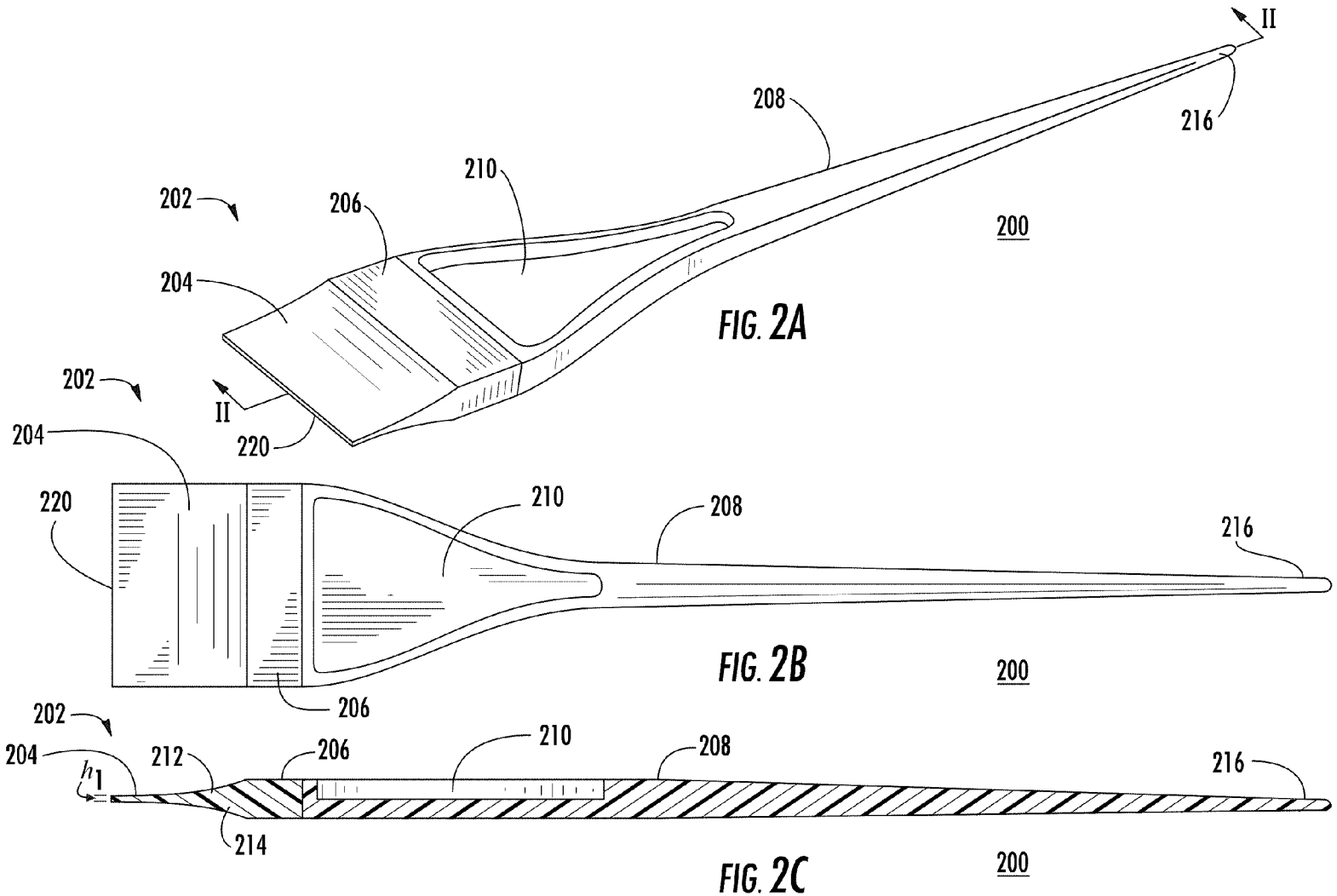
FIG. 2A is a perspective view of an apparatus for manipulating spreadable material having a straight edge in accordance with one embodiment of the present invention.
FIG. 2B is a top view of the apparatus depicted in FIG. 2A.
FIG. 2C is a cross-sectional view of the apparatus depicted in FIG. 2A taken along lines II-II of FIG. 2A.

Referring now to FIG. 2A, depicted is a perspective view of applicator 200 having a straight edge 220. The other features of applicator 200 including head 202, first head end 204, second head end 206, handle 208, indentation 210, upwardly facing first head end surface 212, downwardly facing first head end surface 214, and handle point 216, respectively, are similar to head 102, first head end 104, second head end 106, handle 108, indentation 110, upwardly facing first head end surface 112, downwardly facing first head end surface 114, and handle point 116 as discussed above with respect to FIGS. 1A-1C. However, the inclusion of straight edge 220 in lieu of serrated teeth 118 allows a more precise application of a spreadable material to a surface, as a user is not concerned about application of the quantity of spreadable material held within serrated teeth 118. Rather, a user of applicator 200 may paint the spreadable material such that it begins at a straight (rather than weaved) edge via use of straight edge 220.

Referring next to FIG. 2B, a top view of applicator 200 including a top view of straight edge 220 is depicted. Straight edge 220 allows a more precise application of a spreadable material such as hair color, hair lightener, and the like to be applied to a surface such as the surface of a set of strands of hair as compared to applicator 100. The straight nature of head 202 provides a straight line of color, thereby providing a stark look. Also, some hair colorists may find applicator 200 easier or tougher to use than one or more of applicators 100 and 300-900. Such difficulty may be based upon the individual skills of the hair colorist or may be due to personal preference of the hair colorist. Consequently, provision of multiple embodiments of the applicator of the present invention allows the hair colorist to choose an applicator based upon a plurality of factors such as the applicator that he or she prefers, the applicator that will achieve the desired look, the applicator that will work best for the specific client's hair type, and the like.

Turning next to FIG. 2C, depicted is a cross-sectional view of applicator 200 taken along lines II-II of FIG. 2A further detailing the equally tapered nature of first head end 204, the height $h_1$ of straight edge 220, and the tapered nature of handle 208. In the depicted embodiment, the height $h_1$ of straight edge 220 is approximately 1/16 of an inch and the edge is perfectly straight. However, straight edges 220 having varying heights (e.g., 1/32 inch, 3/16 inch, 1/8 inch, etc.) and varying vertical angles (e.g., 30 degrees, 45 degrees, etc.) may be substituted without departing from the scope of the present invention. Varying the height and/or vertical angle of straight edge 220 may vary the look of the highlight achieved via use of applicator 200 and/or its ease of use for a particular hair stylist. Therefore, a hair colorist may be equipped with a plurality of applicators 200 having varying dimensions, as well as applicator 100 (FIGS. 1A-1C), applicator 300 (FIGS. 3A-3C), applicator 400 (FIGS. 4A-4C), applicator 500 (FIGS. 5A-5C), applicator 600 (FIGS. 6A-6D), applicator 700 (FIGS. 7A-7C), applicator 800 (FIGS. 8A-8D), and/or applicator 900 (FIGS. 9A-9C) such that the appropriate applicator may be selected to achieve the desired highlighting affect. The equally tapered nature of first head end 204 contributes to its brush-like and flexible nature, however, varying tapers may be substituted without departing from the scope of the present invention.

Figures 3A, 3B, 3C:
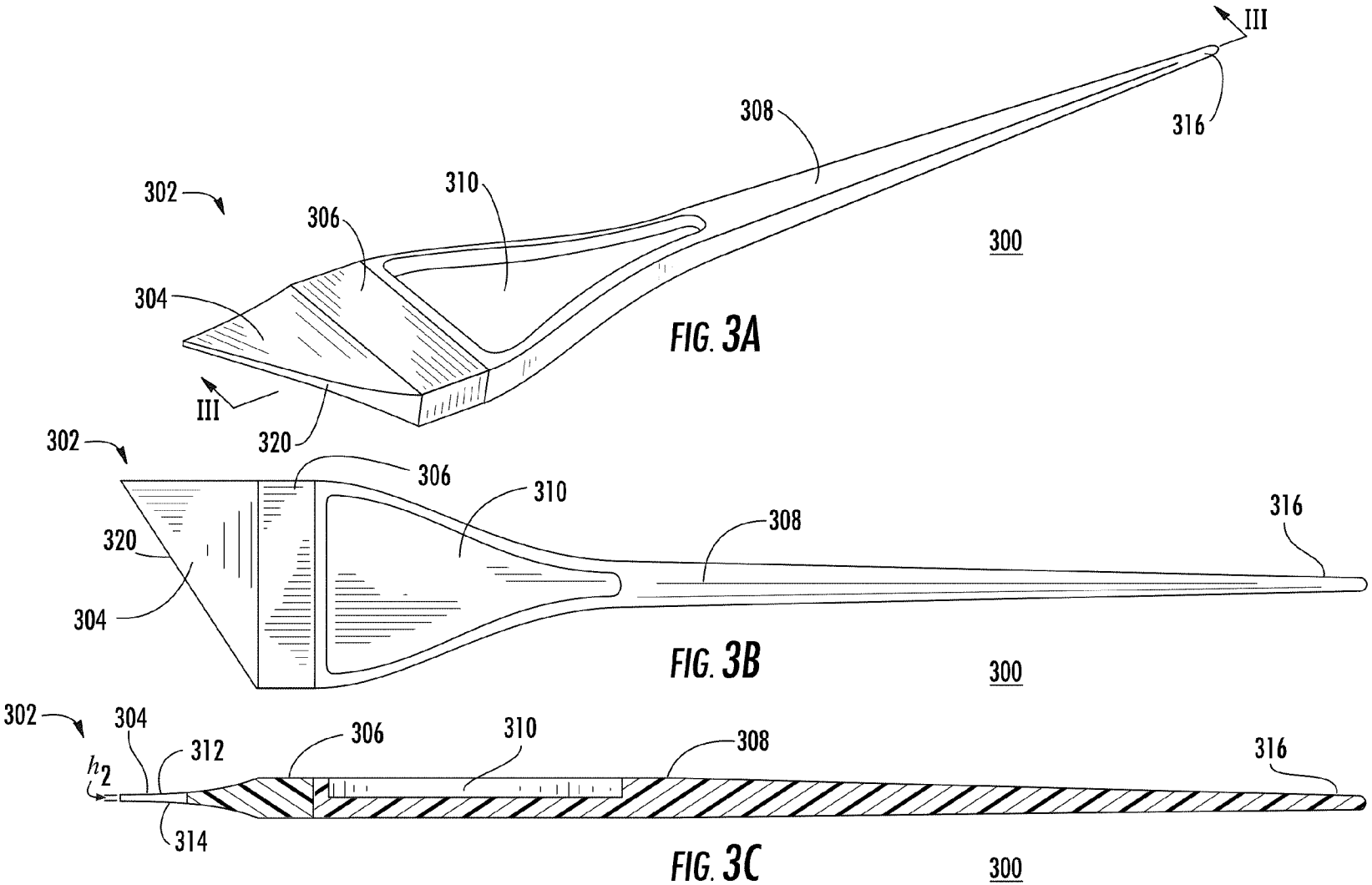
FIG. 3A is a perspective view of an apparatus for manipulating spreadable material having an angled edge in accordance with one embodiment of the present invention.
FIG. 3B is a top view of the apparatus depicted in FIG. 3A.
FIG. 3C is a cross-sectional view of the apparatus depicted in FIG. 3A taken along lines III-III of FIG. 3A.

Now referencing FIG. 3A, depicted is a perspective view of applicator 300 having an angled edge 320. The other features of applicator 300 including head 302, first head end 304, second head end 306, handle 308, indentation 310, upwardly facing first head end surface 312, downwardly facing first head end surface 314, and handle point 316, respectively, are similar to head 102, first head end 104, second head end 106, handle 108, indentation 110, upwardly facing first head end surface 112, downwardly facing first head end surface 114, and handle point 116 as discussed above with respect to FIGS. 1A-1C. However, the inclusion of angled edge 320 in lieu of serrated teeth 118 and/or straight edge 220 allows a different application of spreadable material in that, for example, the line of material applied to the hair has an edge that approximates the angle of angled edge 320 rather than a weaved edge or straight edge as formed by serrated teeth 118 (FIGS. 1A-1C) and straight edge 220 (FIGS. 2A-2C), respectively. That is, the hair color is applied close to the scalp for those portions of the strands of hair that are in contact with the rightmost side of first head end 304 and the hair color is applied progressively farther from the scalp for those portions of the strands of hair that are in contact with the leftmost side of first head end 304. Such application provides a different look than that achieved by use of the non-angled versions of the applicator of the present invention.

Referring next to FIG. 3B, a top view of applicator 300 including a top view of angled edge 320 is depicted. Angled edge 320 allows a more precise application of a spreadable material such as hair color, hair lightener, and the like to be applied to a surface such as the surface of a set of strands of hair as compared to applicator 100. The angled nature of head 302 provides an angled line of color approximating the angle of head 302. Also, some hair colorists may find applicator 300 easier or tougher to use than one or more of applicators 100-200, and 400-900. Such difficulty may be based upon the individual skills of the hair colorist or may be due to personal preference of the hair colorist. Consequently, provision of multiple embodiments of the applicator of the present invention allows the hair colorist to choose an applicator based upon a plurality of factors such as the applicator that he or she prefers, the applicator that will achieve the desired look, the applicator that will work best for the specific client's hair type, and the like.

Turning next to FIG. 3C, depicted is a cross-sectional view of applicator 300 taken along lines III-III of FIG. 3A further detailing the equally tapered nature of first head end 304, the height $h_2$ of straight edge 320, and the tapered nature of handle 308. In the depicted embodiment, the height $h_2$ of angled edge 320 is approximately 1/16 of an inch and the edge is perfectly straight. However, angled edges 320 having varying heights (e.g., 1/32 inch, 3/16 inch, 1/8 inch, etc.) and varying vertical angles (e.g., 30 degrees, 45 degrees, etc.) may be substituted without departing from the scope of the present invention. Varying the height and/or vertical angle of straight edge 320 may vary the look of the highlight achieved via use of applicator 300 and/or its ease of use for a particular hair stylist. Therefore, a hair colorist may be equipped with a plurality of applicators 300 having varying dimensions, as well as applicator 100 (FIGS. 1A-1C), applicator 200 (FIGS. 2A-2C), applicator 400 (FIGS. 4A-4C), applicator 500 (FIGS. 5A-5C), applicator 600 (FIGS. 6A-6D), applicator 700 (FIGS. 7A-7C), applicator 800 (FIGS. 8A-8D), and/or applicator 900 (FIGS. 9A-9C), such that the appropriate applicator may be selected to achieve the desired highlighting affect. The equally tapered nature of first head end 304 contributes to its brush-like and flexible nature, however, varying tapers may be substituted without departing from the scope of the present invention.

Figures 4A, 4B, 4C:
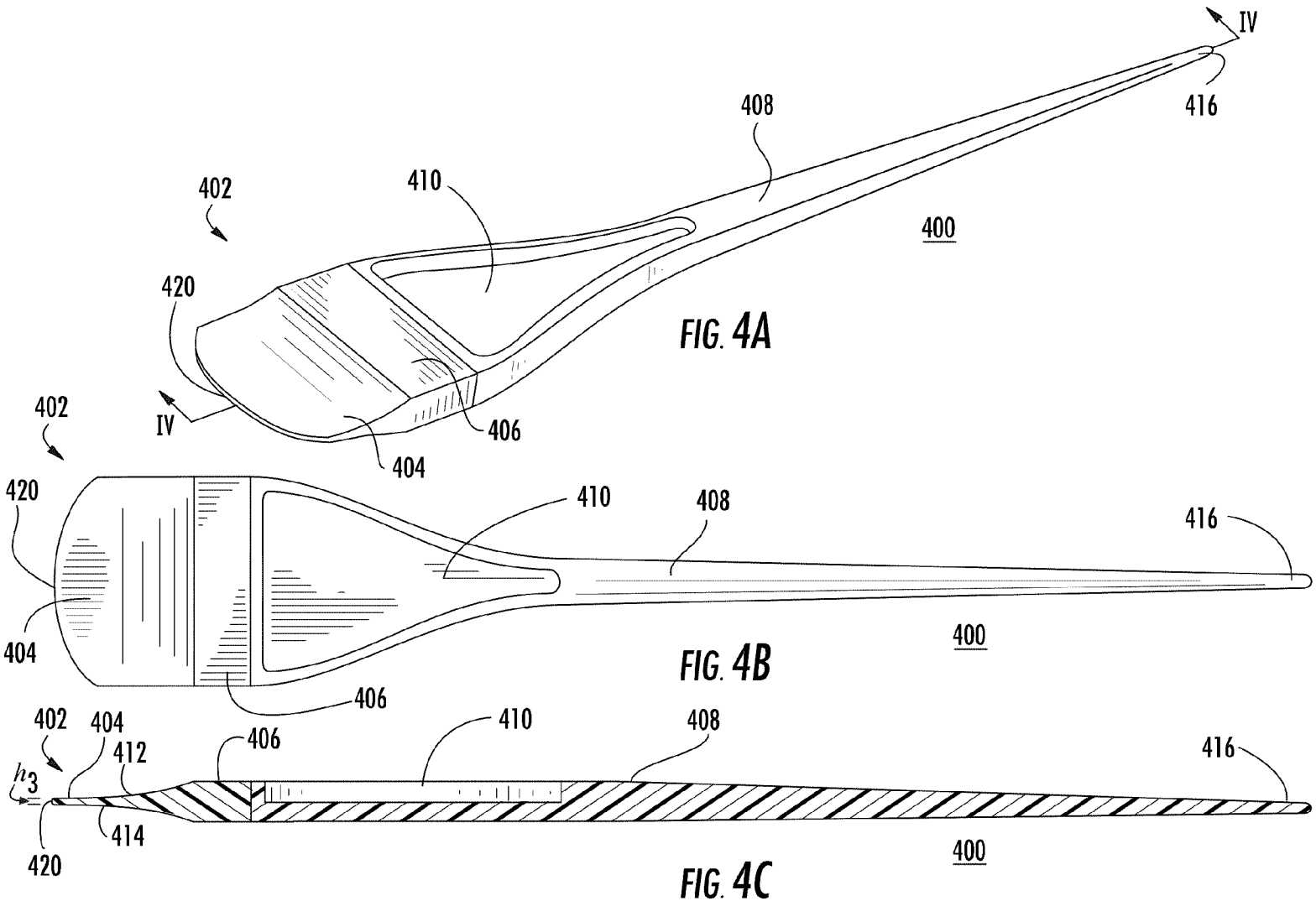
FIG. 4A is a perspective view of an apparatus for manipulating spreadable material having a rounded edge in accordance with one embodiment of the present invention.
FIG. 4B is a top view of the apparatus depicted in FIG. 4A.
FIG. 4C is a cross-sectional view of the apparatus depicted in FIG. 4A taken along lines IV-IV of FIG. 4A.

Turning next to FIG. 4A, depicted is a perspective view of applicator 400 having a rounded edge 420. The other features of applicator 400 including head 402, first head end 404, second head end 406, handle 408, indentation 410, upwardly facing first head end surface 412, downwardly facing first head end surface 414, and handle point 416 are similar to head 102, first head end 104, second head end 106, handle 108, indentation 110, upwardly facing first head end surface 112, downwardly facing first head end surface 114, and handle point 116, respectively, as discussed above with respect to FIGS. 1A-1C. However, the inclusion of rounded edge 420 in lieu of serrated teeth 118, straight edge 220, and/or angled edge 320 allows a different application of spreadable material in that, for example, the line of material applied to the hair has an edge that approximates rounded edge 420 rather than a weaved edge, straight edge, or angled edge as formed by serrated teeth 118 (FIGS. 1A-1C), straight edge 220 (FIGS. 2A-2C), and angled edge 320 (FIGS. 3A-3C), respectively. That is, the hair color is applied close to the scalp for those portions of the strands of hair that are in contact with the center of first head end 404 and the hair color is applied progressively farther from the scalp for those portions of the strands of hair that are in contact with the right and left sides of first head end 404. Such application provides a different look than that achieved by use of the non-rounded versions of the applicator of the present invention.

Referring next to FIG. 4B, a top view of applicator 400 including a top view of rounded edge 420 is depicted. Rounded edge 420 allows a more precise application of a spreadable material such as hair color, hair lightener, and the like to be applied to a surface such as the surface of a set of strands of hair as compared to applicator 100. The rounded nature of head 402 provides a line of color approximating the rounded edge of head 402. Also, some hair colorists may find applicator 400 easier or tougher to use than one or more of applicators 100-300 and 500-900. Such difficulty may be based upon the individual skills of the hair colorist or may be due to personal preference of the hair colorist. Consequently, provision of multiple embodiments of the applicator of the present invention allows the hair colorist to choose an applicator based upon a plurality of factors such as the applicator that he or she prefers, the applicator that will achieve the desired look, the applicator that will work best for the specific client's hair type, and the like.

Turning next to FIG. 4C, depicted is a cross-sectional view of applicator 400 taken along lines IV-IV of FIG. 4A further detailing the equally tapered nature of first head end 404, the height $h_3$ of rounded edge 420, and the tapered nature of handle 408. In the depicted embodiment, the height $h_2$ of rounded edge 420 is approximately 1/16 of an inch and the edge is perfectly straight. However, rounded edges 420 having varying heights (e.g., 1/32 inch, 3/16 inch, 1/8 inch, etc.) and varying vertical angles (e.g., 30 degrees, 45 degrees, etc.) may be substituted without departing from the scope of the present invention. Varying the height and/or vertical angle of rounded edge 420 may vary the look of the highlight achieved via use of applicator 400 and/or its ease of use for a particular hair stylist. Therefore, a hair colorist may be equipped with a plurality of applicators 400 having varying dimensions, as well as applicator 100 (FIGS. 1A-1C), applicator 200 (FIGS. 2A-2C), applicator 300 (FIGS. 3A-3C), applicator 500 (FIGS. 5A-5C), applicator 600 (FIGS. 6A-6D), applicator 700 (FIGS. 7A-7C), applicator 800 (FIGS. 8A-8D), and/or applicator 900 (FIGS. 9A-9C) such that the appropriate applicator may be selected to achieve the desired highlighting affect. The equally tapered nature of first head end 404 contributes to its brush-like and flexible nature, however, varying tapers may be substituted without departing from the scope of the present invention.

Figures 5A, 5B, 5C:
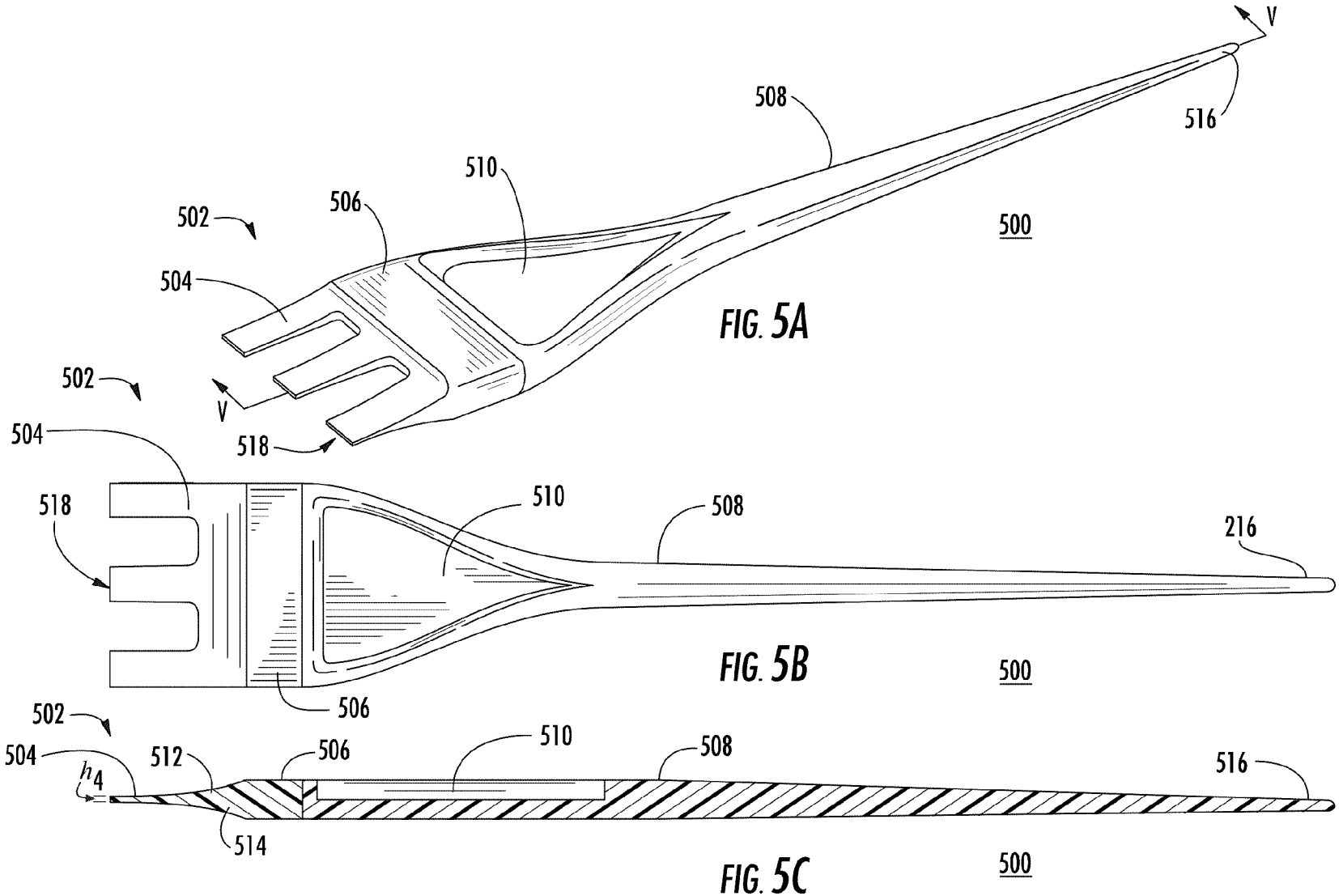
FIG. 5A is a perspective view of an apparatus for manipulating spreadable material having forked teeth in accordance with one embodiment of the present invention.
FIG. 5B is a top view of the apparatus depicted in FIG. 5A.
FIG. 5C is a cross-sectional view of the apparatus depicted in FIG. 5A taken along lines V-V of FIG. 5A.

Referring now to FIG. 5A, depicted is a perspective view of applicator 500 having forked teeth 518. The other features of applicator 500 including head 502, first head end 504, second head end 506, handle 508, indentation 510, upwardly facing first head end surface 512, downwardly facing first head end surface 514, and handle point 516 are similar to head 102, first head end 104, second head end 106, handle 108, indentation 110, upwardly facing first head end surface 112, downwardly facing first head end surface 114, and handle point 116, respectively, as discussed above with respect to FIGS. 1A-1C. However, the inclusion of forked teeth 518 in lieu of serrated teeth 118 allows a different application of a spreadable material to a surface, for example, the line of material applied to the hair has an edge that approximates forked teeth 518 of head 502 rather than a weaved edge, straight edge, angled edge, or rounded edge as formed by serrated teeth 118 (FIGS. 1A-1C), straight edge 220 (FIGS. 2A-2C), angled edge 320 (FIGS. 3A-3C), rounded edge 420 (FIGS. 4A-4C), respectively. That is, a user of applicator 500 may paint, or otherwise apply, the spreadable material to a surface such as hair in a manner that omits the strands of hair that fall between forked teeth 518. The omission of these strands of hair allows the user to apply a spreadable material, such as coloring, in a choppier fashion, thereby creating a more drastic contrast between the colors of the processed and unprocessed hair.

Referring next to FIG. 5B, a top view of applicator 500 including a top view of forked teeth 518 is depicted. The forked tooth nature of head 502 provides intermittent lines of spreadable material such as hair color, thereby providing a choppier variation of hair coloring. Also, some hair colorists may find applicator 500 easier or tougher to use than one or more of applicators 100-400 and 600-900. Such difficulty may be based upon the individual skills of the hair colorist or may be due to personal preference of the hair colorist. Consequently, provision of multiple embodiments of the applicator of the present invention allows the hair colorist to choose an applicator based upon a plurality of factors such as the applicator that he or she prefers, the applicator that will achieve the desired look, the applicator that will work best for the specific client's hair type, and the like.

Turning next to FIG. 5C, depicted is a cross-sectional view of applicator 500 taken along lines V-V of FIG. 5A, further detailing the equally tapered nature of first head end 504, the height $h_4$ of forked teeth 518, and the tapered nature of handle 508. In the depicted embodiment, the height $h_4$ of forked teeth 518 is approximately 0.035 to 0.040 inches. However, forked teeth 518 having varying heights (e.g., 1/32 inch, 3/16 inch, 1/8 inch, etc.) and individual teeth having varying widths may be substituted without departing from the scope of the present invention. Varying the height of forked teeth 518 and/or the width of the individual teeth may vary the look of the highlight or other hair treatment achieved via use of applicator 500 and/or its ease of use for a particular hair stylist. Therefore, a hair colorist may be equipped with a plurality of applicators 500 having varying dimensions, as well as applicator 100 (FIGS. 1A-1C), applicator 200 (FIGS. 2A-2C), applicator 300 (FIGS. 3A-3C), applicator 400 (FIGS. 4A-4C), applicator 600 (FIGS. 6A-6D), applicator 700 (FIGS. 7A-7C), applicator 800 (FIGS. 8A-8D), and/or applicator 900 (FIGS. 9A-9C) such that the appropriate applicator may be selected to achieve the desired highlighting affect. The equally tapered nature of first head end 504 contributes to its brush-like and flexible nature, however, varying tapers may be substituted without departing from the scope of the present invention.

Figure 6A:
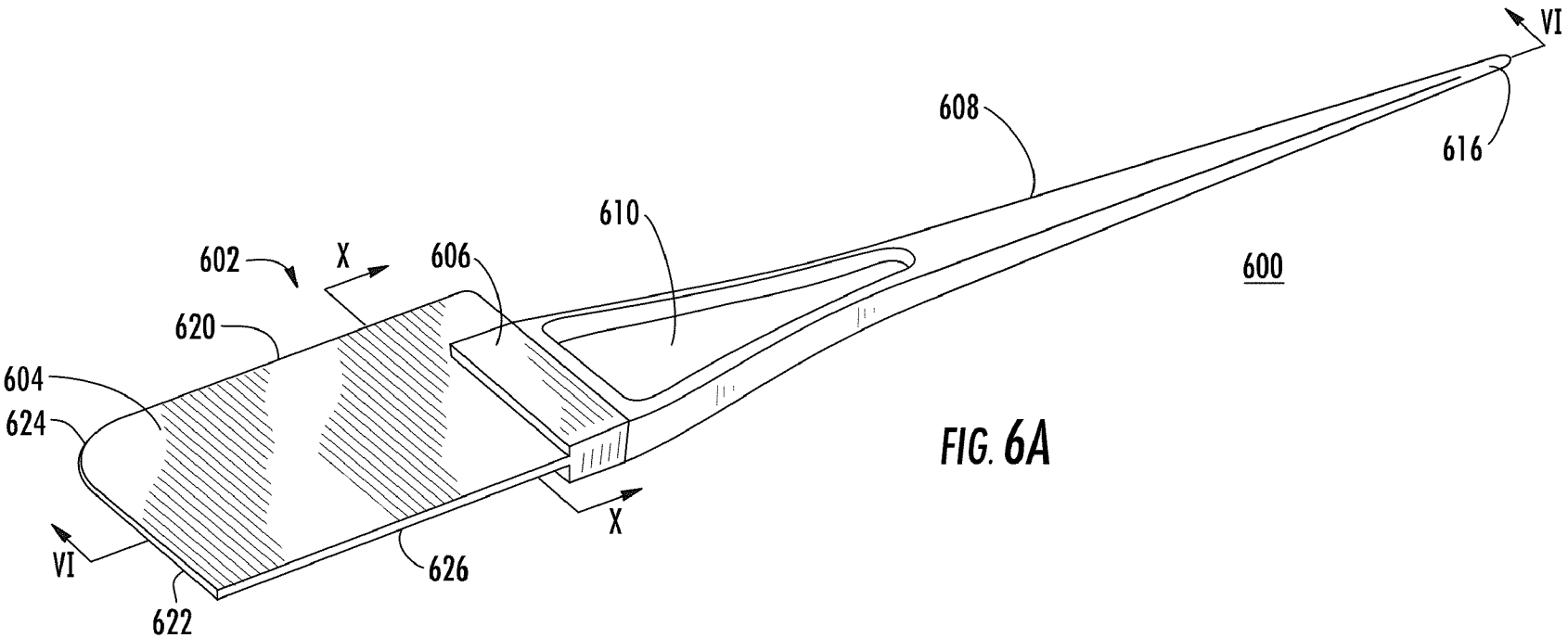
FIG. 6A is a perspective view of an apparatus for manipulating spreadable material having an enlarged head with a protruding longitudinal edge in accordance with one embodiment of the present invention.

Referring now to FIG. 6A, depicted is a perspective view of applicator 600 having an enlarged head 602 with a protruding longitudinal edge 620, edge 622, and rounded corner 624. The other features of applicator 600 including head 602, first head end 604, second head end 606, handle 608, indentation 610, and handle point 616 are similar to head 102, first head end 104, second head end 106, handle 108, indentation 110, and handle point 116, respectively, as discussed above with respect to FIGS. 1A-1C. However, the inclusion of protruding longitudinal edge 620, edge 622, and rounded corner 624 in lieu of serrated teeth 118 allows applicator 600 to have features such as those described with respect to applicator 200, 300, and 400, as well as its own unique features.

First, the straight portions of edge 622 may be used in a manner similar to straight edge 220 as described in greater detail above with respect to FIGS. 2A-2C. That is, the straight portions of edge 622 allows a more precise application of spreadable material to a surface. In addition, rounded corner 624 may be used in a manner similar to rounded edge 420 as described in greater detail above with respect to FIGS. 4A-4C. That is, rounded corner 624 may be used to apply materials such as coloring, relaxer, and the like in a manner that approximates the curved nature of rounded corner 624. Or, alternatively, applicator 600 may be manipulated in a manner that allows the user to alternate between the straight edges of edge 622 and protruding longitudinal edge 620 as well as the curved edge of rounded corner 624 as desired by the user to facilitate his or her individual coloring style.

Additionally, protruding longitudinal edge 620 protrudes beyond second head end 606 to facilitate use of protruding longitudinal edge 620 for the application of spreadable materials to a surface. When used in this manner in our exemplary hair coloring embodiment, applicator 600 is held such that handle 608 is relatively perpendicular to the length of hair to which the color is to be applied, as compared to the relatively parallel position in which the handles of applicators such as applicators 100, 200, 300, 400, 500, 800, and 900 are held. Use of applicator 600 in this manner allows it to be used in a similar manner to a brush, thereby providing the feel and the comfort of brushes currently used in the art for similar applications. However, the combination of edge 622, rounded corner 624, and protruding longitudinal edge 620 allows a user to alternate between both styles of use, providing increased functionality for applicator 600.

Although, applicator 600 is depicted in FIGS. 6A-6D with only one protruding longitudinal edge 620, applicator 600 is not so limited. For example, applicator 600 may be configured such that opposing edge 626 also protrudes beyond second head end 606, thereby allowing a user to incorporate any one or more of all four edges (protruding longitudinal edge 620, edge 622, rounded corner 624, and opposing edge 626) when applying a spreadable material to a surface. Furthermore, the edge joining edge 622 and opposing edge 626 may be independently configured as a second rounded corner such as rounded corner 624, as a square, perpendicular edge, or any other edge variation without departing from the scope of the present invention.

Additionally, any one or more of protruding longitudinal edge 620, edge 622, rounded corner 624, and opposing edge 626 may be configured exactly or similarly to straight edge 220, angled edge 320, or rounded edge 420. Furthermore, any one of these edges and/or corners may include serrated teeth 118 and/or forked teeth 518 or may be ridged such as ridged first head end 804. Any combination of the features discussed herein may be formed to add to the versatility of applicator 600 and/or to customize such applicator to the needs and desires of the user. In yet another embodiment, opposing edges such as protruding longitudinal edge 620 and opposing edge 626 may be identical to allow a user who is applying two or more materials (e.g., low lights and high lights) to simply reverse applicator 600 rather than using two separate applicators.

Figure 6B:
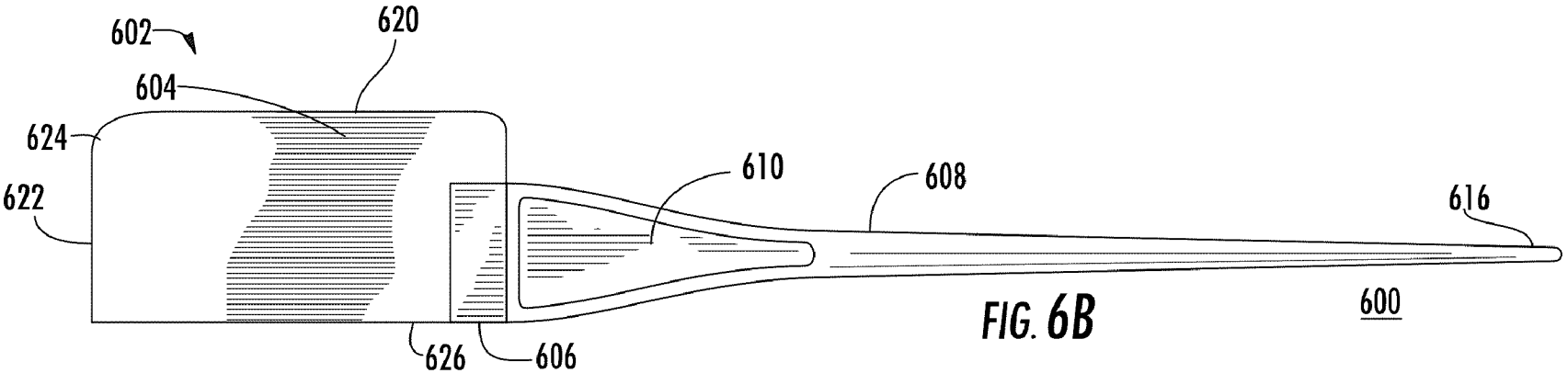
FIG. 6B is a top view of the apparatus depicted in FIG. 6A.

Referring next to FIG. 6B, a top view of applicator 600 including protruding longitudinal edge 620, edge 622, rounded corner 624, and opposing edge 626 is depicted. Some hair colorists may find applicator 600 easier or tougher to use than one or more of applicators 100-500 and 700-900. Such difficulty may be based upon the individual skills of the hair colorist or may be due to personal preference of the hair colorist. Consequently, provision of multiple embodiments of the applicator of the present invention allows the hair colorist to choose an applicator based upon a plurality of factors such as the applicator that he or she prefers, the applicator that will achieve the desired look, the applicator that will work best for the specific client's hair type, and the like.

Figure 6C:
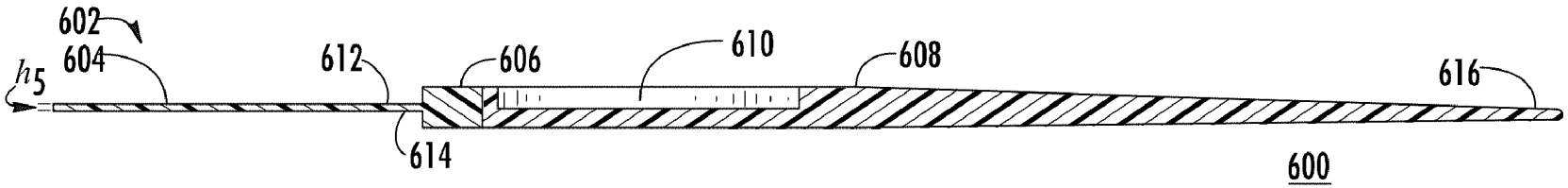
FIG. 6C is a cross-sectional view of the apparatus depicted in FIG. 6A taken along lines VI-VI of FIG. 6A.

Turning next to FIG. 6C, depicted is a cross-sectional view of applicator 600 taken along lines VI-VI of FIG. 6A further detailing the non-tapered nature of first head end 604, the height $h_5$ of, and the tapered nature of handle 608. In the depicted embodiment, the height $h_5$ of protruding longitudinal edge 620 is approximately 0.035 to 0.040 inches and the edge is relatively straight. However, varied edges 620 having varying heights (e.g., 1/32 inch, 3/16 inch, 1/8 inch, etc.), varying vertical angles (e.g., 30 degrees, 45 degrees, etc.), and tapered or otherwise configured surfaces may be substituted without departing from the scope of the present invention. Although upwardly and downwardly facings surfaces 612 and 614, respectively, are depicted as straight, one or both surfaces may be alternatively configured (e.g., ridged). Such variations may vary the look of the highlight achieved via use of applicator 600 and/or its ease of use for a particular hair stylist. Therefore, a hair colorist may be equipped with a plurality of applicators 600 having varying dimensions and/or configurations, as well as applicator 100 (FIGS. 1A-1C), applicator 200 (FIGS. 2A-2C), applicator 300 (FIGS. 3A-3C), applicator 400 (FIGS. 4A-4C), applicator 500

(FIGS. 5A-5C), applicator 700 (FIGS. 7A-7C), applicator 800 (FIGS. 8A-8D), and/or applicator 900 (FIGS. 9A-9C) such that the appropriate applicator may be selected to achieve the desired highlighting affect.

Figure 6D:
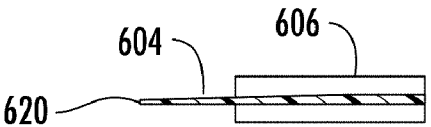
FIG. 6D is a cross-sectional view of the apparatus depicted in FIG. 6A taken along lines X-X of FIG. 6A.
Figure 7A:
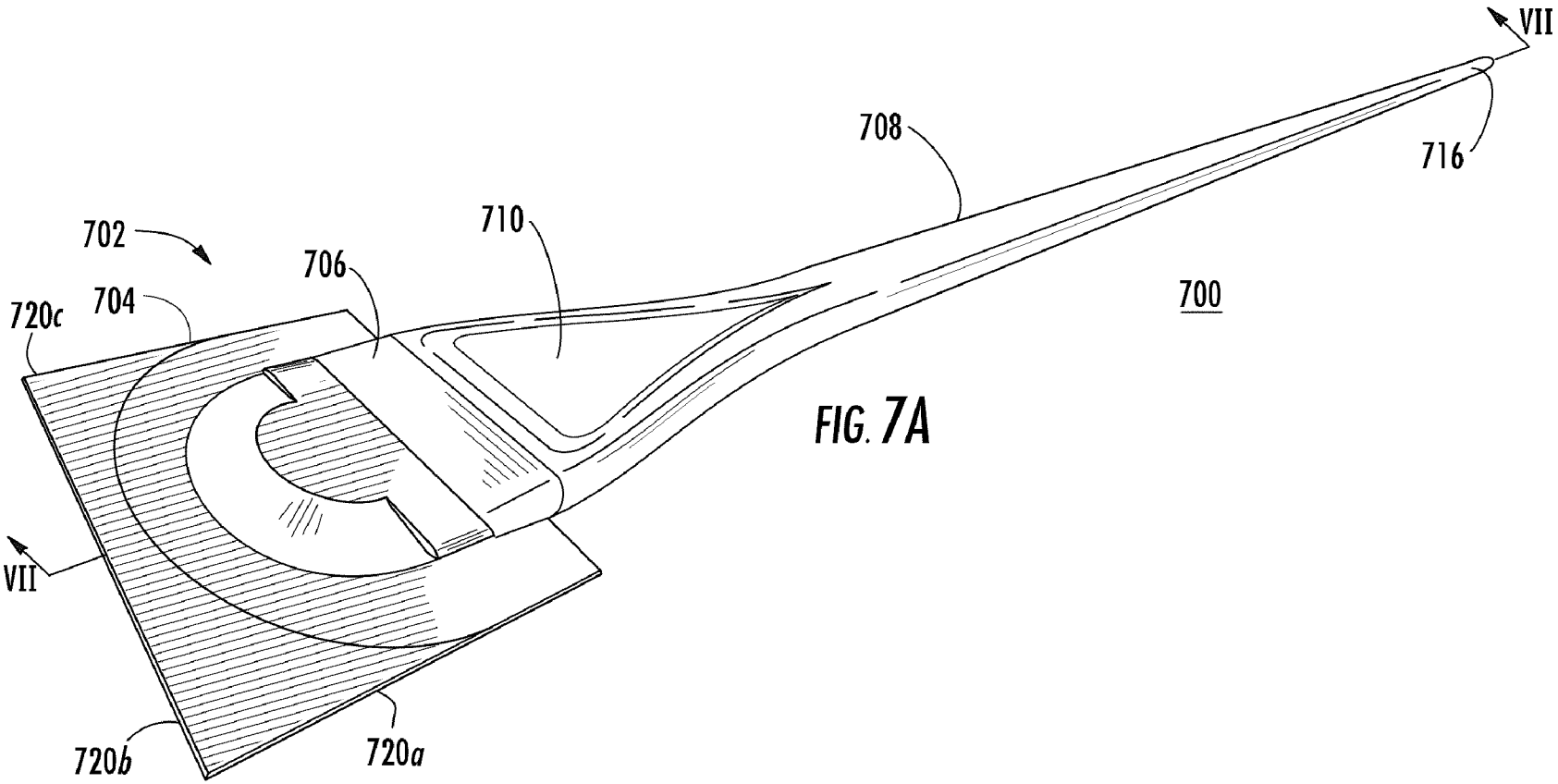
FIG. 7A is a perspective view of an apparatus for manipulating spreadable material having a user-definable head in accordance with one embodiment of the present invention.

Referring now to FIG. 6D, depicted is a cross-sectional view of applicator 600 taken along lines X-X of FIG. 6A. Such view more clearly depicts the tapered nature of longitudinal edge 620. However, alternate configurations for longitudinal edge 620 may be substituted without departing from the scope hereof Referring now to FIG. 7A, depicted is a perspective view of applicator 700 having a user-definable first head end 704. User-definable first head end 704 includes first, second, and third convertible edges 720*a*, 720*b*, 720*c*, respectively. The other features of applicator 700 including second head end 706, handle 708, indentation 710, and handle point 716 are similar to second head end 106, handle 108, indentation 110, and handle point 116, respectively, as discussed above with respect to FIGS. 1A-1C.

User-definable first head end 704 may be manufactured from the same or similar materials as those discussed above with respect to first end head 104. However, the width of user-definable first head end 704 protrudes latitudinally beyond second head end 706 such that when a user cuts or otherwise manipulates user-definable first head end 704, the remaining portions of same will remain stable with respect to handle 708. Also, in some embodiments of applicator 700 of the present invention, the length of user-definable first head end 704 is longer than the length of first head end 104. That is, the distance between second head end 706 and second convertible edge 720*b* is greater than the distance between second head end 106 and the tips of serrated teeth 118. User-definable first head end 704 is also tapered from second convertible edge 720*b* toward second head end 706, as described in further detail below with respect to FIG. 7C. However, the other features of head 102 as described above with respect to FIGS. 1A-1C (e.g., minimal or no waste of spreadable material, flexibility, etc.) are features also available with head 702.

The configuration of user-definable first head end 704 is designed to allow a user to create a customized applicator. This may be accomplished via cutting any one or more of first, second, and third convertible edges 720*a*, 720*b*, 720*c*, respectively, into the desired configuration via any type of cutting device such as a scissor, knife, razor blade, or the like. This allows a user to incorporate any one or more of the styles discussed herein (e.g., serrated teeth 118, straight edge 220, angled edge 320, rounded edge 420, forked teeth 518, protruding longitudinal edge 620, rounded corner 624, etc.) and/or any one or more styles, variations, and the like not discussed herein such that the user may minimize the quantity of applicators required for a particular process and may eliminate or minimize the need to switch between multiple applicators during the application process. Not only does this flexibility allow the user to accommodate his or her specific needs, but it further allows the user to experiment with new hair processing concepts, providing more versatility to their clients.

The protruding nature of first and third convertible edges 720*a* and 720*c*, respectively, beyond second head end 706 allows applicator 700 to be used in the perpendicular manner as described above with respect to FIG. 6A, whereas second convertible edge 720*b* allows applicator 700 to be used in the manner described with respect to applicators 100, 200, 300, 400, 500, 800, and 900. Furthermore, the protruding nature of first and third convertible edges 720*a* and 720*c*, respectively, allows a significant portion of head 702 to be cut away or otherwise eliminated while retaining the stability of head 702 with respect to handle 708.

Also envisioned is a competition or award process for users who create their own unique edges and/or applicators. This competition may exist to allow users the opportunity to share their design ideas with their colleagues, or, alternatively, such competition may result in the receipt of an award. In its simplest form, this award may be a monetary or gift reward. Alternatively, the award could be designed to add prestige to the user or his or her salon. For example, a user with a winning design might be featured in advertising such as website, commercial, or print advertising. Additionally, a desirable applicator may be named after the applicator designer or his or her salon. In addition to adding prestige to the designer or salon, such designer or salon may incorporate the applicator in its own advertisements.

Figure 7B:
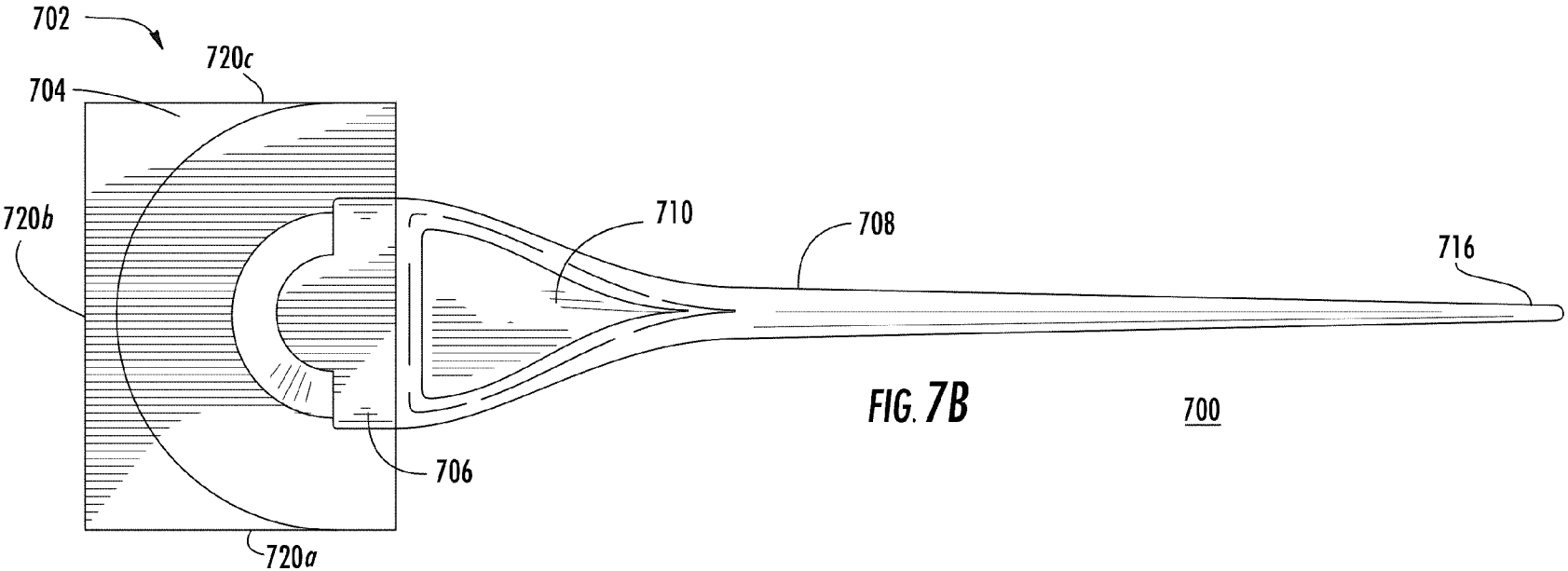
FIG. 7B is a top view of the apparatus depicted in FIG. 7A.

Referring next to FIG. 7B, a top view of applicator 700 including a top view of user-definable first head end 704 is depicted. The dimensions of user-definable first head end 704 as well as the dimensions of first, second, and third convertible edges 720*a*, 720*b*, 720*c*, respectively, allow a user to create an applicator 700 with dimensions similar to applicators 100-500, and/or 600 or with dimensions smaller or larger than such applicators. Also, the dimensions of first, second, and third convertible edges 720*a*, 720*b*, 720*c* are intentionally larger than required by the user such that when a user cuts or otherwise manipulates user-definable first head end 704, the remaining portions of same will remain stable with respect to handle 708.

Figure 7C:
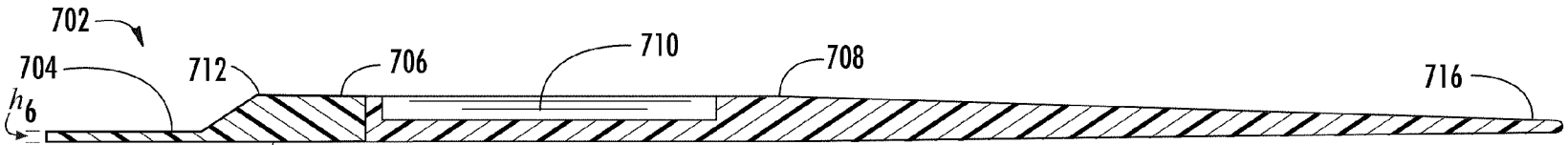
FIG. 7C is a cross-sectional view of the apparatus depicted in FIG. 7A taken along lines VII-VII of FIG. 7A.

Turning next to FIG. 7C, depicted is a side view of applicator 700 further detailing the semi-tapered nature of convertible first head end 704, the initial height $h_6$ of second convertible edge 720*b*, and the tapered nature of handle 708. Although not depicted, the heights of first and third convertible edges, 720*a* and 720*c*, respectively, are envisioned to be equivalent to height $h_6$. In the depicted embodiment, the height $h_6$ of user-definable first head end 704 is approximately 0.035 to 0.040 inches. However, first, second, and/or third convertible edges 720*a*, 720*b*, 720*c*, respectively, may have varying initial heights (e.g., 1/16 inch, 1/32 inch, 3/16 inch, 1/8 inch, etc.) and varying vertical angles (e.g., 30 degrees, 45 degrees, etc.) without departing from the scope of the present invention. Although upwardly and downwardly facing surfaces 712 and 714, respectively, are depicted as tapered and straight, respectively, one or both surfaces may be alternatively configured. Varying the height and/or vertical angle of first, second, and/or third convertible edges 720*a*, 720*b*, 720*c*, respectively, may vary the look of the highlight achieved via use of applicator 700 and/or its ease of use for a particular hair stylist.

Although the user-configurable applicator 700 has been shown having a square head 702 of a specific dimension relative to handle 708, varying head configurations and relative dimensions may be substituted without departing from the scope of the present invention. Furthermore, varying handles may be substituted without departing from the scope hereof.

Figures 8A, 8B, 8C:
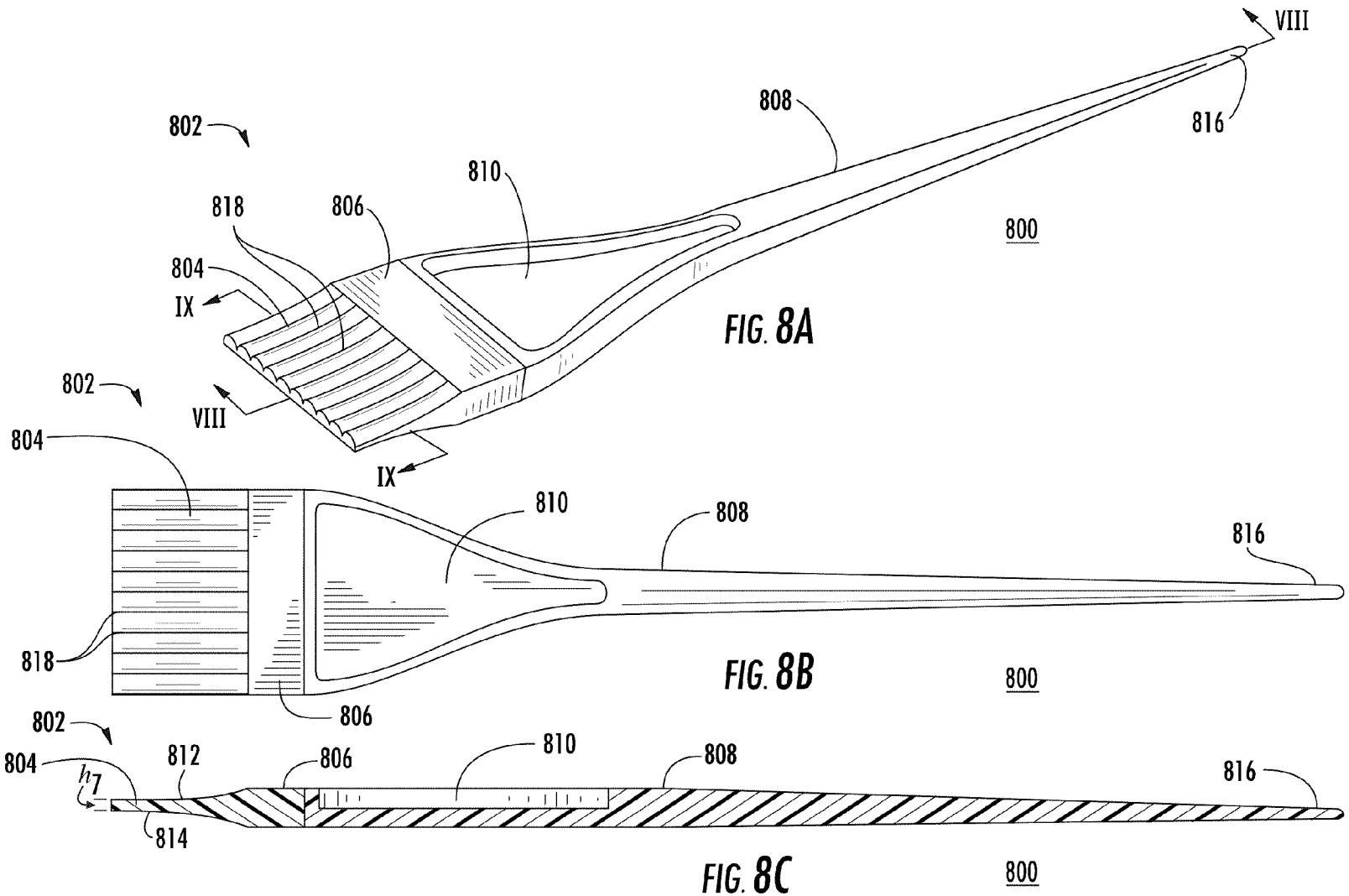
FIG. 8A is a perspective view of an apparatus for manipulating spreadable material having a ridged head in accordance with one embodiment of the present invention.
FIG. 8B is a top view of the apparatus depicted in FIG. 8A.
FIG. 8C is a cross-sectional view of the apparatus depicted in FIG. 8A taken along lines VIII-VIII of FIG. 8A.

Referring now to FIG. 8A, depicted is a perspective view of applicator 800 having a ridged first head end 804 including ridges 818. The other features of applicator 800 including head 802, second head end 806, handle 808, indentation 810, and handle point 816 are similar to head 102, second head end 106, handle 108, indentation 110, and handle point 116, respectively, as discussed above with respect to FIGS. 1A-1C. However, the inclusion of ridges 818 in lieu of serrated teeth 118 allows applicator 800 to be used for varying material applications such as baliage highlighting. Baliage highlighting is a free-form painting technique in which foil is not used. This method often obtains a more natural effect that mimics that of sun induced highlights. Baliage may be used alone or in conjunction with other methods of highlighting. Historically, the highlighting material has been applied with a color brush. However, such method may be performed with an applicator of the present invention to achieve the benefits thereof (e.g., minimal waste, ease of cleaning, etc.) as discussed in greater detail above.

The inclusion of ridges 818 within first head end 804 in lieu of serrated teeth 118 allows a different application of a spreadable material to a surface. In our exemplary hair processing embodiment, a user may apply a hair processing material (e.g., a highlighting material) such that some strands of hair are contained within ridges 818. Such application allows the hair within ridges 818 to become more saturated with the material as compared to the hair that is not contained within ridges 818. This method of applying hair processing material such as a highlighting material, colorant, or the like provides a more nature look to the hair by varying the color of adjacent strands of hair. Such subtle variations approximate the coloring of unprocessed hair. Although ridges 818 are depicted as being equivalent in size and curvature, applicator 800 is not so limited. Ridges 818 may vary in size and shape as well as distance relative to adjacent ridges 818. For example, ridges 818 could be V-shaped such that they include no curvature whatsoever. Also, different shaped or sized ridges 818 may be included in the same applicator 800. Additionally, the quantity of ridges 818 may vary. Virtually any configuration of ridges may be substituted without departing from the scope of the present invention.

Referring next to FIG. 8B, a top view of applicator 800 including a top view of first head end 804 and ridges 818 is depicted. Ridges 818 allow a more varied application of a spreadable material such as hair color, hair lightener, relaxers, and the like to be applied to a surface such as the surface of strands of hair. The ridged nature of head 802 provides varying quantities of hair processing material to each strand of hair, thereby providing a more natural look. Also, some hair colorists may find applicator 800 easier or tougher to use than one or more of applicators 100-700 and 900. Such difficulty may be based upon the individual skills of the hair colorist or may be due to the personal preference of the hair colorist. Consequently, provision of multiple embodiments of the applicator of the present invention allows the hair colorist to choose an applicator based upon a plurality of factors such as the applicator that he or she prefers, the applicator that will achieve the desired look, the applicator that will work best for the specific client's hair type, and the like.

Turning next to FIG. 8C, depicted is a cross-sectional view of applicator 800 taken along lines VIII-VIII of FIG. 8A further detailing the height $h_7$ of first head end 804 and the tapered nature of handle 808. In the depicted embodiment, the height $h_7$ of first head end 804 is approximately 0.035 to 0.040 inches. However, first head ends 804 having varying heights (e.g., 1/32 inch, 3/16 inch, 1/8 inch, etc.) may be substituted without departing from the scope of the present invention. Although upwardly and downwardly facings surfaces 812 and 814, respectively, are depicted as tapered, one or both surfaces may be alternatively configured. Varying the height of first head end 804 may vary the look of the highlight achieved via use of applicator 800 and/or its ease of use for a particular hair stylist by allowing different quantities of hair to be saturated. Therefore, a hair colorist may be equipped with a plurality of applicators 800 having varying dimensions, as well as applicator 100 (FIGS. 1A-1C), applicator 200 (FIGS. 2A-2C), applicator 300 (FIGS. 3A-3C), applicator 400 (FIGS. 4A-4C), applicator 500 (FIGS. 5A-5C), applicator 600 (FIGS. 6A-6D), applicator 700 (FIGS. 7A-7C), and/or applicator 900 (FIGS. 9A-9C) such that the appropriate applicator may be selected to achieve the desired highlighting affect. The equally tapered nature of first head end 804 contributes to its brush-like and flexible nature, however, varying tapers may be substituted without departing from the scope of the present invention.

Figure 8D:
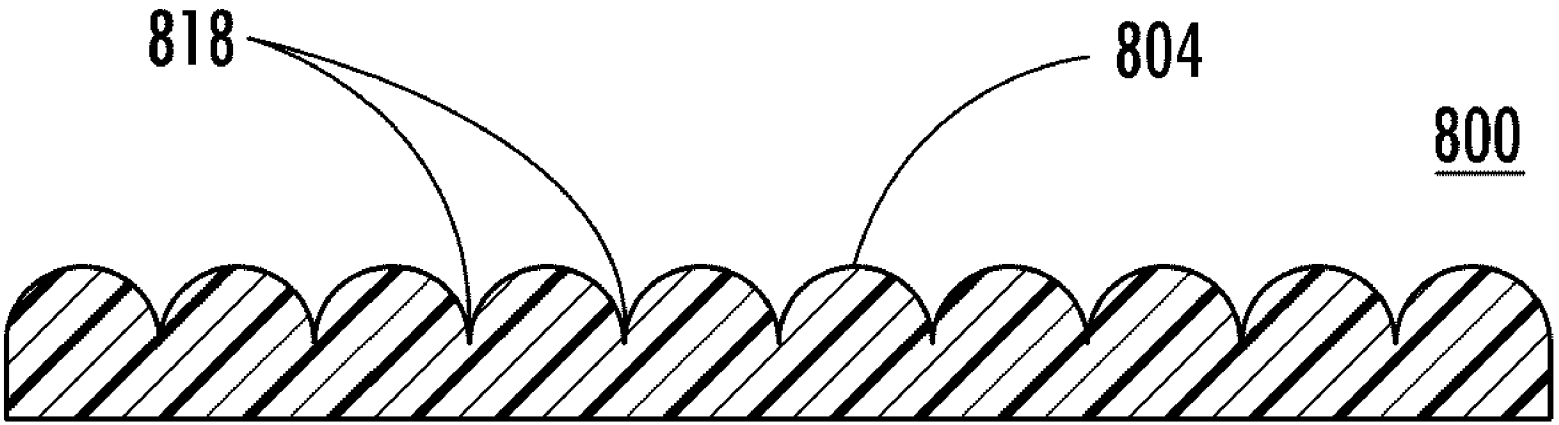
FIG. 8D is a cross-sectional view of the apparatus depicted in FIG. 8A taken along lines IX-IX of FIG. 8A.

Referring now to FIG. 8D, depicted is a cross-sectional view of applicator 800 depicted in FIG. 8A taken along lines IX-IX of FIG. 8A. Such view more clearly depicts the ridged nature of upwardly facing surface 812. However, alternate configurations for one or more of upwardly and downwardly facings surfaces 812 and 814, respectively, may be substituted without departing from the scope hereof.

Figure 9A:
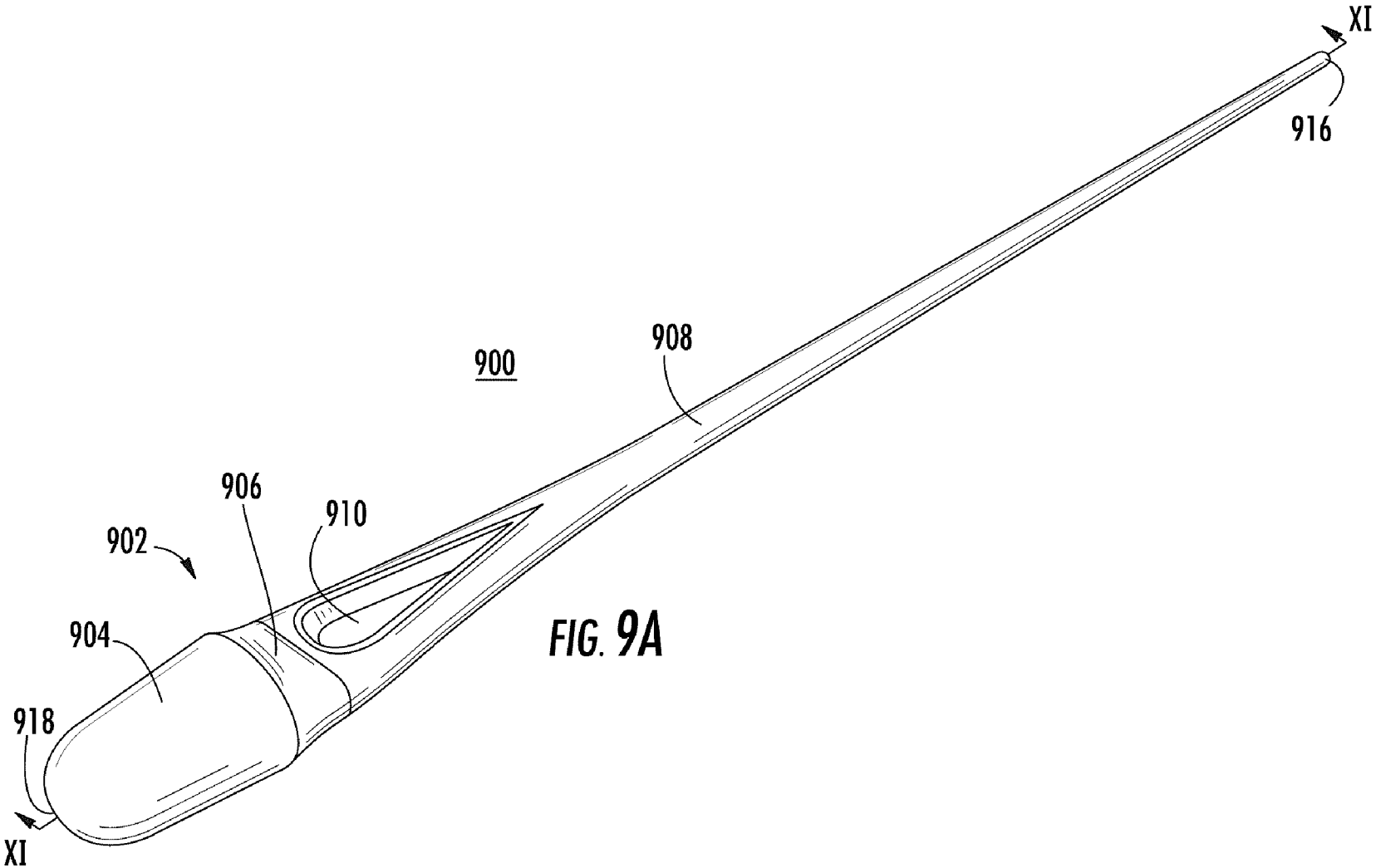
FIG. 9A is a perspective view of an apparatus for manipulating spreadable material having a tapered cylindrical head in accordance with one embodiment of the present invention.

Turning next to FIG. 9A, depicted is a perspective view of applicator 900 having a ovate tip 918. The other features of applicator 900 including tapered cylindrical head 902, first head end 904, second head end 906, handle 908, indentation 910, and handle point 916 are similar to head 102, first head end 104, second head end 106, handle 108, indentation 110, and handle point 116, respectively, as discussed above with respect to FIGS. 1A-1C. However, the inclusion of tapered cylindrical head 902 and ovate tip 918 in lieu of serrated teeth 118, straight edge 220, angled edge 320, rounded edge 420, forked teeth 518, enlarged head 602, user-definable first head end 704, and/or ridged first head end 804 allows a different application of spreadable material in that, for example, the material applied to the hair has no edge. That is, unlike the other embodiments in which the material may simulate an edge that approximates the edge of the applicator (e.g., a rounded edge, a weaved edge, a straight edge, an angled edge, etc.), applicator 900, due to its tapered cylindrical nature, is capable of applying a material with no edge whatsoever. However, hair color may still be applied close to the scalp. Such application provides a different look than that achieved by use of the other applicators of the present invention. Although applicator 900 is depicted with a tapered cylindrical head 902 having a ovate tip 918, other head and/or tip embodiments may be substituted to achieve a similar affect (e.g., a circular head, a circular tip, etc.) without departing from the scope of the present invention.

Figure 9B:
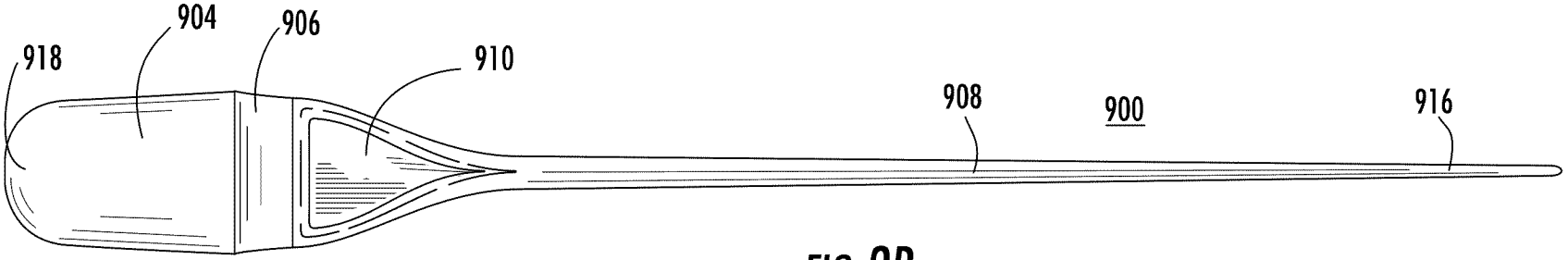
FIG. 9B is a top view of the apparatus depicted in FIG. 9A.

Referring next to FIG. 9B, a top view of applicator 900 including a top view of tapered cylindrical head 902 and ovate tip 918 is depicted. Ovate tip 918 allows a less precise application of a spreadable material such as hair color, hair lightener, and the like to be applied to a surface such as the surface of a set of strands of hair as compared to applicators such as applicators 100-600 and 800. Also, some hair colorists may find applicator 900 easier or tougher to use than one or more of applicators 100-800. Such difficulty may be based upon the individual skills of the hair colorist or may be due to personal preference of the hair colorist. Consequently, provision of multiple embodiments of the applicator of the present invention allows the hair colorist to choose an applicator based upon a plurality of factors such as the applicator that he or she prefers, the applicator that will achieve the desired look; the applicator that will work best for the specific client's hair type, and the like.

Figure 9C:
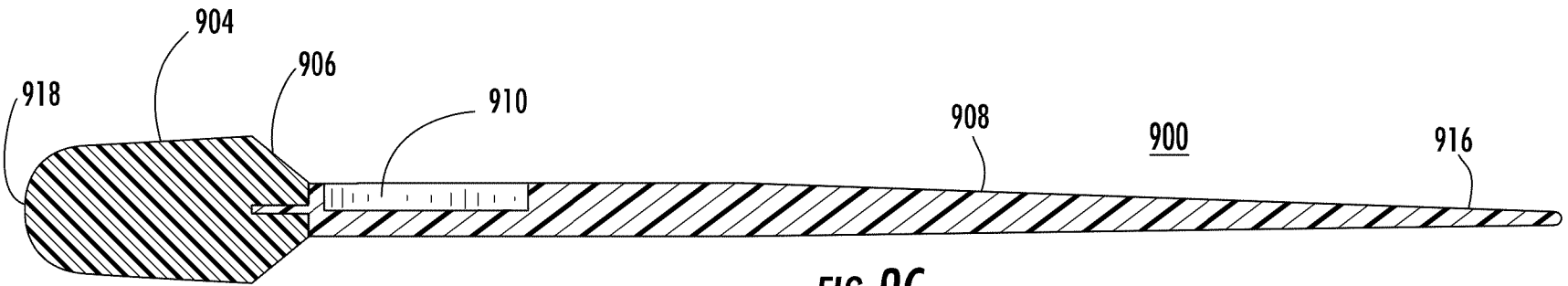
FIG. 9C is a cross-sectional view of the apparatus depicted in FIG. 9A taken along lines XI-XI of FIG. 9A.

Turning next to FIG. 9C, depicted is a cross-sectional view of applicator 900 taken along lines XI-XI of FIG. 9A further detailing the equally tapered cylindrical nature of head 902, the ovate nature of tip 918, and the tapered nature of handle 908. As applicator 900 is capable of achieving a different application of spreadable materials to a surface, a hair colorist may be equipped with a plurality of applicators 900 having varying dimensions, as well as applicator 100 (FIGS. 1A-1C), applicator 200 (FIGS. 2A-2C), applicator 300 (FIGS. 3A-3C), applicator 400 (FIGS. 4A-4C), applicator 500 (FIGS. 5A-5C), applicator 600 (FIGS. 6A-6D), applicator 700 (FIGS. 7A-7C), and/or applicator 800 (FIGS. 8A-8D) such that the appropriate applicator may be selected to achieve the desired highlighting affect.

Although FIGS. 1A-9C depict nine (9) configurations of heads 102 through 902, varying head configurations having virtually any type of edge may be substituted without departing from the scope of the present invention including, but not limited to, waved edges, undulated edges, jagged edges, sinusoidal edges, lettered edges, and the like. In addition, varying head configurations having virtually any type of surface, taper, dimensions, etc. may be substituted without departing from the scope of the present invention.

Although the applicators discussed herein are shown having particular head configurations having specific dimension relative to the respective handle, varying head configurations and relative dimensions may be substituted without departing from the scope of the present invention. Furthermore, virtually any type or style of handle may be substituted without departing from the scope hereof including without limitation those without indentions, handle points, etc. and those having varying configurations, dimensions, and the like.

Although many applicator variations have been specifically enumerated herein, it should be noted that many other non-enumerated applicator variations are within the scope of the present invention. Furthermore, many of the features of a specific enumerated applicator may be applied to other enumerated and non-enumerated applicators without departing from the scope hereof.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of applying a hair processing material to a user's hair comprising the steps of:

1) Providing an apparatus having head being made of thermal plastic elastomer material, said head comprising a thickened proximal end portion and a gradually tapered distal end portion, an upwardly facing surface and a downwardly facing surface, wherein upwardly facing surfacing and downwardly facing surface forming curved edges at said distal end portion; a handle having a proximal end and a distal end, said proximal end of said handle having an equal width and thickness to said proximal end of said head, said proximal end of said handle including an indentation which is recessed below a surface of said proximal end of said handle, said proximal end of said handle being moldably coupled to the proximal end of said head, said handle being tapered toward its distal end, wherein said distal end of said handle including a pointed tip;

2) applying said hair processing material to said head of the apparatus; and 3) applying said hair processing material to at least one strand of user's hair with said apparatus.

* * * * *